US008620003B2

(12) United States Patent
Vincent et al.

(10) Patent No.: US 8,620,003 B2
(45) Date of Patent: Dec. 31, 2013

(54) EMBEDDED AUDIO SYSTEM IN DISTRIBUTED ACOUSTIC SOURCES

(75) Inventors: Stephen Saint Vincent, Ames, IA (US); Robert Katz, Montreal (CA)

(73) Assignee: Robert Katz, Montreal Quebec (CA)

( * ) Notice: Subject to any disclaimer, the term of this patent is extended or adjusted under 35 U.S.C. 154(b) by 1696 days.

(21) Appl. No.: 12/006,921

(22) Filed: Jan. 7, 2008

(65) Prior Publication Data

US 2009/0175484 A1 Jul. 9, 2009

(51) Int. Cl.
*H04R 3/02* (2006.01)

(52) U.S. Cl.
USPC ..... 381/73.1; 381/152; 381/56; 381/59

(58) Field of Classification Search
None
See application file for complete search history.

(56) References Cited

U.S. PATENT DOCUMENTS

| | | | | |
|---|---|---|---|---|
| 5,442,710 | A * | 8/1995 | Komatsu | 381/162 |
| 5,511,129 | A * | 4/1996 | Craven et al. | 381/103 |
| 6,594,365 | B1 * | 7/2003 | Eatwell | 381/73.1 |
| 6,904,154 | B2 | 6/2005 | Azima et al. | |
| 2002/0021812 | A1 * | 2/2002 | Bank | 381/152 |
| 2002/0027999 | A1 * | 3/2002 | Azima et al. | 381/431 |
| 2003/0007653 | A1 * | 1/2003 | Azima et al. | 381/152 |
| 2004/0037447 | A1 * | 2/2004 | Kam | 381/431 |
| 2004/0184623 | A1 * | 9/2004 | Johannsen et al. | 381/117 |
| 2005/0065778 | A1 * | 3/2005 | Mastrianni et al. | 704/200.1 |
| 2006/0147051 | A1 * | 7/2006 | Smith et al. | 381/71.2 |
| 2007/0092092 | A1 * | 4/2007 | Kondo et al. | 381/152 |
| 2007/0230717 | A1 * | 10/2007 | Akino | 381/113 |
| 2008/0181438 | A1 * | 7/2008 | Beckinger et al. | 381/300 |
| 2008/0298604 | A1 * | 12/2008 | Starobin et al. | 381/73.1 |

FOREIGN PATENT DOCUMENTS

WO WO 2006133812 A1 * 12/2006 ..... H04S 3/00

* cited by examiner

*Primary Examiner* — Benjamin Sandvik
*Assistant Examiner* — Leslie Pilar Cruz
(74) *Attorney, Agent, or Firm* — Camille L. Urban; David M. Breiner

(57) ABSTRACT

The invention converts non audio systems into distributed audio sources for active noise control solutions. The system transforms non acoustic structures into soundboards using inertial type acoustic transducers. Acoustic parameters unique for each application due to the variation in properties of the sound board are compensated by equalizers. The invention also uses damping means to limit the reflection of bending waves from the edges. The inertial type acoustic transducer is driven by an amplifier. The acoustic signal to the amplifier is modified by a signal conditioner to compensate for the non optimal response of the acoustic system. An external controller communicates with the amplifier to control its operating parameters. A series of distributed audio sources in a variety of positions may each be addressable as a node on a network wherein noise detected at that source is analyzed and the system generates sound at that source to mask the noise.

55 Claims, 7 Drawing Sheets

EMBEDDED AUDIO SYSTEM IN DISTRIBUTED ACOUSTIC SOURCES

FIELD OF INVENTION

This invention relates to an audio system. In one aspect, this invention relates to the conversion of otherwise non audio systems such as office furniture, walls, ceilings and floors into distributed audio sources for active noise control solutions for acoustical privacy.

BACKGROUND OF THE INVENTION

The office workspace has undergone significant changes in the last 30 years where work areas have become smaller with increasing emphasis on collaboration.

Sound control is a vital aspect of worker efficiency. Significant effort is expended in the design of the workspace in order to control the acoustics, reducing the environmental noise that interferes with a worker's concentration. In addition, public spaces are often plagued with environmental noise. It is desirable to reduce the perception and effect of environmental noise in public areas such as airports, subways, and trains.

Historically, sound control has been through the deployment of passive means such as large separation distances, acoustical ceiling tile, carpeting, partitions, and other absorptive materials to reduce the sound waves as they propagate from the source to a listener.

However, in the contemporary design standards, the distance between workstations is being substantially reduced. In addition, interior design is seeking to remove many of the absorption surfaces to create a cleaner environment. All of these elements are collaborating to create an acoustic environment where it is difficult to achieve optimal worker efficiency.

Office designers have noted that the noise level is not necessarily distracting. What has been determined is most distracting are those sounds that attract attention such as conversation between two or more people, fragments of telephone conversations, personal acoustic eruptions, etc. The attention attractor is the information content.

A further advance in office noise control is the addition of sound in the form of filtered white noise. The noise is shaped to decrease the signal to noise ratio of the distracting sound to the point where the sound is no longer intelligible and hence distracting. In this application, the speakers are typically mounted in the plenum between the acoustic ceiling and the overhead. The speakers are acoustic point sources where the projected sound has directionality that is frequency dependent. Effective coverage of masking sound is difficult in that the ideal application is one where the sound transmitting through the acoustic ceiling is uniform and of the correct spectral content. The basic sound characteristics of the sources make this a difficult task. Further complicating the matter is that the acoustic point sources typically need to operate at higher levels to overcome the acoustic absorption of the ceiling.

A more recent development in noise masking is the generation of acoustic babble. (US Patent Application Publication No. US/2005/0065778A1) In this process, a person's voice is processed by an electronic signal processor which randomly inverts, time delays and then feeds the processed signal to an audio speaker. The resulting acoustic signal substantially reduces the intelligibility of speech to where it is no longer a distraction to a worker within the original speaker's acoustic field.

U.S. Pat. No. 6,904,154 teaches that optimal performance of a distributed mode loudspeaker includes a member extending transversely and capable of sustaining bending waves over an area of the member. The member having a distribution of resonant modes of its natural bending wave vibration dependent on specific values of particular parameters, including geometrical configuration and directional bending stiffness(es). The values have been selected to predetermine the distribution of natural resonant modes consonant with required achievable acoustic action for operation of the device over a desired operative acoustic frequency range.

The distributed mode loudspeaker of the '154 patent is impractical in a built environment having structures and furnishings that rarely fall within the design parameters of the described distributed mode loudspeakers. In addition, the placement of the inertial type transducer is determined by factors related to optimal acoustic placement, but not relative to aesthetics, tampering, and convenience in installation and maintenance.

US Pat. Application No. US2006/0147051 A1 teaches inertial transducers of the magnetostrictive form using Giant Magnetostrictive Materials (GMM) as the active element. These types of inertial transducers have limited low frequency performance, excessive distortion and limited overall displacement. Mechanical engineering efforts to increase low frequency performance come at the expense of additional distortion. The limited displacement of the GMM based inertial transducer also restrict their application to panels or structures that are relatively stiff, thus not making them suitable for many other built environment surfaces. The '05 application teaches the use of a controller mixer for comparing ambient noise or other signal to control the acoustic output of the overall system or cause notification of other engagement with the system. The patent does not address configuring the signal for optimal acoustic response of the driven structure to improve audio fidelity to the input signal. Further, the application teaches that the invention can be used for anti-noise control but fails to address how a spatially incoherent acoustic source can create a coherent anti-phase signal for active noise cancellation.

SUMMARY OF INVENTION

It is therefore an objective of the present invention to provide a system and a method for improving the acoustic performance of a building interior such as but not limited to an open office plan, exhibition space or other public or living space. A further objective includes improving the overall worker efficiency within a workstation by utilization of otherwise non acoustic elements and surfaces of the built environment such as walls, ceilings, floors, windows, columns and finished case goods such as workstations, furniture, partitions, cabinets, whiteboards, tables and other commonly available furnishings within an interior environment to radiate sound by means of acoustically driving the aforementioned.

Another objective of the invention is to provide a means of optimizing the acoustic performance of the aforementioned traditionally non acoustic elements and surfaces of the built environment and other commonly available furnishings to result in audio reproduction that is optimally faithful to the input acoustic signal.

It is another objective of the invention to provide a means of actively adapting a masking signal to be configured for both general and localized environments thereby maximizing the effectiveness throughout the built environment.

According to the present invention, the transformation of otherwise non acoustic structures into acoustic soundboards is affected by the acoustic association of inertial type acoustic transducers which converts an electrical signal into a mechanical motion of said soundboard. The resulting mechanical motion in the attached soundboard structure then acoustically radiates into the surrounding environment.

Acoustic soundboard structure can be comprised of flat, single curve and multiple curved panels. These panels can be constructed of a nearly endless array of materials with a suitable range of mechanical properties. Examples of these materials are gypsum panels, glass, composite structures of a structural member with resin or metallic binders, wood, wood sheet goods, composite panels of structural skins and cores, consolidated organic and inorganic fibers, structural foams, metal, etc. A narrow subset of an acoustic source design having a distributed mode loudspeaker typically includes a regular geometric panel, preferred mechanical properties of said panel, and preferential acoustic exciter location relevant to the panel geometry to obtain a desired acoustic performance and frequency response. However, ill defined soundboards lacking the preferred mechanical properties and geometric regularity are far more plentiful and common. What is needed is a system that works around or with these properties.

It is common practice for an inertial type acoustic transducer to drive a soundboard structure that is ill defined both in geometry and mechanical properties. However, the acoustic performance using ill defined soundboards has heretofore been of low quality. Examples of ill defined soundboards are comprised of many different materials and applications such as panel type materials commonly used in building construction, outdoor leisure products, vehicles, furniture, etc. Some of the most widely available materials suitable for soundboard applications are the 1/32" to 1' thick sheet materials such as gypsum drywall, plywood, MDF, glass, consolidated fiber materials of natural and synthetic origin, composite fiber reinforced plastics, and metals. Panels may be configured from flat to compound curved structures that are capable of both pistonic and flexural bending motion.

The present invention describes a method and apparatus for optimizing the acoustic performance of the transducer coupled with a soundboard, even an ill defined soundboard. The method and apparatus is designed to compensate for the various physical properties and optimize the corresponding radiated sound.

The nearly universal use of these ill defined soundboards in building environments means it is nearly impossible to control the parameters that influence the acoustic radiation of the system. The radiated frequency response can vary significantly even with a single type of material such as gypsum panels used commonly in framed wall construction. These variabilities in acoustic radiation response are dependent upon such factors as the area of the wall, center spacing of the framing members, spacing distance and regularity of the mechanical fasteners attaching the gypsum panel to the framing, type of framing, and application of construction adhesive between frame and gypsum panel.

Although the acoustic parameters are unique from one application or installation to the next due to the variation in actual panel geometry, and in mechanical properties such as material thickness, modulus of elasticity and area density, these variations can be suitably compensated by means of parametric equalizers, graphic equalizers or other active and passive filter means.

Those skilled in the art of loudspeaker design will recognize the challenges of creating a sound reproduction system that is faithful to the original acoustic signal in light of these uncontrollable variables.

The present invention provides an inertial type acoustic transducer acoustically associated with a soundboard panel and driven by an electronic power amplifier. The acoustic signal to the power amplifier is modified by means of a signal conditioner to compensate for the non optimal response of the acoustic system. The preferred signal conditioner is a digital signal processor which employs algorithms for parametric equalization. Other common features that are implemented in the digital signal processor capabilities are graphic equalization, channel mixing, bass and treble tone control, high and low pass crossover frequency control, high and low pass digital filters for crossover network control and subwoofer integration, and independent channel gain.

Frequency and Transducer Relationship

The present invention also proposes a means for using multiple channels of amplification to acoustically drive the associated transducer over its optimal frequency bandwidth. The preferred implementation of limiting the frequency bandwidth to the respective transducer is through digital means. However, this invention is not limited to using digital cross-over networks.

Other possible implementations of inertial type transducers acoustically associated with a soundboard are the use of a plurality of acoustic transducers that are optimized to operate over a limited frequency range. Those skilled in the art will know that electrodynamic transducers have increasing electrical impedance with increasing frequency. This is related to the mutual inductive coupling between the voice coil and the magnetic structure. This increasing impedance will typically act as a first or second order low pass filter. The present invention improves the high frequency performance by using means of decreasing the mutual inductance through a shorting ring that promotes formation of blocking eddy currents in the magnetic circuit. Alternatively, different transducers may be configured for high frequency operation. An example of this is the use of different transducers for low and high frequency operation. Limiting the audio signal frequency bandwidth to the respective transducer can be done through an electronic crossover network in the digital signal processor or through passive crossover networks that are well known to those familiar to the art of loudspeaker design.

Advantages of Soundboard as a Sound Radiator a. Room Resonance and Feedback Loop Avoidance Sound radiation from a soundboard is different from a traditional speaker. The radiation from a soundboard results from bending waves being introduced into a panel. The propagation of the bending wave speed is frequency dependent, thus as broadband energy is input to the panel, the panel motion becomes random. The non linear propagation speed generates broadband wave number spectra in which some radiate to the far field. The near field acoustic energy has evanescent decay properties and does not radiate to the far field.

The modal dispersion of the bending wave energy in the panel causes the soundboard to have a unique acoustic center of radiation at each instant in time. Over time, this acoustic center point averages to a location at or near the point of acoustic stimulation. This phenomenon of instantaneous center of acoustic radiation means that at a fixed reference point, the distance between the acoustic source and the reference point is different for each time reference. As a result, the soundboard will not necessarily stimulate normal room resonant modes or in the case of a microphone pickup, cause feedback loop gain. This advantage is a result of the spatially incoherent nature of the acoustic radiation. This phenomenon has been exploited in the present invention to suppress room mode resonance or in the case of amplification of a microphone signal, suppress feedback amplification gain, decreasing the need for notch filters for feedback elimination.

b. Radiation Area and Attenuation as a Basis for Lower Sound Pressure

Observationally, the radiation area of a conventional diaphragm speaker is on the order of 0.005-1.227 square feet corresponding to speaker cones nominally 1-15 inches in diameter. A general rule of thumb is that the far field radiation characteristics are observed at 7 to 8 diameters away. This is in contrast to the acoustic radiation area of a soundboard which in most practical applications is on the order of 1s-100s of square feet. As a result, for most practical applications within a built environment, the listener will be within the near field acoustic radiation of the source. With a conventional speaker where the surface of the cone is substantially coherent (the cone surface is moving in phase relative to each other), the acoustic near field could be problematic in that frequency dependent nulls may be experienced. However, with a soundboard, the surface is spatially incoherent, and the instantaneous center of acoustic pressure is different at each differential time. No near field nulls are experienced.

As a further bonus, the propagation characteristics of sound do not attenuate at the same rate. Practical experience shows that the propagation attenuation is on the order of 1/R, where R is the distance from the source to observation point. For each doubling of distance between source and observation point, the sound level is ½. Conventional speaker attenuation with distance is characteristic of far field radiation and is on the order of $1/R^2$. Thus for each doubling of distance between the acoustic source and observation point, the sound level is reduced by ¼.

The physical implication of this radiation characteristic of the soundboard is that the acoustic source level at the panel can be significantly lower to have the same room filling affect as a conventional speaker playing at a higher sound pressure level.

c. Placement and Orientation not Critical to Frequency Coverage

Those skilled in the art will appreciate the challenges in designing a speaker to have appropriate frequency response in both the main response axis of the speaker as well as the off axis. At high frequencies, the sound tends to focus in a narrow beam and becomes less focused at lower frequencies. In addition, the edges of the speaker baffle can create di-pole radiation affects that will color the off axis response of the speaker system.

In contrast, when using a soundboard, the radiation characteristics are largely omni-directional, meaning that there is no or limited focusing of the acoustic radiation relative to the soundboard. Thus the placement and orientation of soundboard structures needs no special placement or orientation to properly cover the frequency band for masking and/or other audio functionalities.

d. Damping Means to Limit Reflection of Bending Waves

Some materials with low internal damping return a significant portion of the incident bending wave energy back into the panel at the panel terminus. The substantial change in panel impedance at the edge of the panel causes the incident bending wave to be reflected back toward the acoustic transducer which can induce back Electro Magnetic Field (EMF) into the driving power amplifier. The back EMF into the power amplifier can increase output signal distortion, thus reducing the overall fidelity of the soundboard output. The present invention addresses the use of visco-elastic or constrained layer and other damping means to limit the reflection of bending waves from the edge of the panel.

Amplifier Architecture a. Amplification and Fidelity Control

The nearly infinite variety in soundboard construction, geometry, and edge boundary conditions all have an affect on the bending wave properties, and hence the ultimate acoustic radiation from said panel. In conventional speaker design, development and production, the speaker engineer carefully selects all aspects of the speaker to arrive at a desired acoustic response. The present invention as described above includes non ideal placement of the inertial type acoustic transducer on non ideal soundboard and will result in acoustic radiation that does not maintain sufficient fidelity to the input audio signal unless that fidelity is otherwise addressed.

In the present invention, the soundboard, inertial acoustic transducer and the power electronics work as a system. The soundboard and acoustic transducer properties are largely predetermined. Thus it is necessary to affect the overall acoustic output of the system to result in a reduction of magnitude distortion. This affect is accomplished by causing preferential adaptation in the power electronics where its amplified signal is inversely distorted to improve the acoustic fidelity of the overall system.

b. Psychoacoustic Processing

Another aspect of the present invention is the utilization of psycho acoustic processing techniques where enhancement of the low and high frequency response may be realized. Psycho-acoustic bass enhancement results in perception of a sound at a low frequency when in fact a component at that frequency is not present. The enhancement provides the added advantage that the bass response of the system is enhanced while reducing the overall physical displacement of the soundboard system. This can be particularly attractive where the physical displacement of the soundboard may have detrimental affects to worker comfort or induces secondary buzzing and rattles.

c. Masking and Separate Zone Control

The digital signal processor of the present invention has integrated computer interfacing means whereby an external controller may communicate with the amplifier to control its operating parameters. These operating parameters are ideally assessable through a graphical user interface. Interfacing and communicating with other computers or controllers is by means of wired and/or wireless networks and may be addressable as a node on a network. This enables the direct distribution and streaming of audio content from centralized network servers. The network may supply a common audio signal to all or a portion of the acoustic zones to create background, foreground music, voice paging or emergency signaling. The audio signal source can be, but is not limited to, line level analog mono/stereo, Sony/Philips Digital Interface Format (S/PDIF), direct digital stream or Ethernet packet.

Multiple distributed acoustic sources may be used throughout the built environment. Each separate acoustic source can be considered a node on a network that is individually addressable for specific audio signal input. The ability to address each acoustic source as an individual node enables further optimization in the active acoustic noise control system where specific masking is applied locally near the point of disturbance. In applications where filtered random noise is utilized, sampling of the background noise near each node can be used to shape the noise spectrum so as to be more effective in masking the acoustic disturbance.

Other masking technologies such as Babble® as supplied by Sonare®, 444 N. Wells, Suite 305, Chicago, Ill. 60610 use pre-recorded speech of a talker. The recorded speech is processed so that when played back in conjunction with actual speech of the talker, the intelligibility of the talker is highly disrupted. The present invention when utilized with Babble can monitor the nodes of the network and when a known talker is detected, the surrounding immediate zones can be activated with the corresponding Babble processed signal, thus rendering a zone of privacy for the talker. Masking and or Babble processing my also be employed to create zones of privacy for open area or closed meeting spaces.

Another aspect of the invention is the ability of a local node to introduce a unique audio signal from sources such as but not limited to MP3 players, radios, CD, portable music players, and computers. The local audio signal will be reproduced at the local zone for personalization of that space and mixed in with the other masking signals for that specific zone. It is also conceivable that a locally input audio signal can be shared with other distributed nodes.

In summary, a major feature of the present invention is the ability of the amplifier to adjust its parameters to address each unique application. The signal conditioned amplifier will power inertial type transducers. The inducers will be mounted on a wide variety of structures such as but not limited to: hot tubs, whirlpool baths, in-ground pools, gypsum paneled walls and ceilings, composite panels such as in marine applications, train carriages, buses and aircraft, wood and wood sheet goods and glass and acrylic panels as employed in architectural and furniture applications.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

BRIEF DESCRIPTION OF THE DRAWING

In the drawings, which illustrate exemplary embodiments of the invention.

DETAILED DESCRIPTION OF THE ILLUSTRATED EMBODIMENTS

Figure 1:
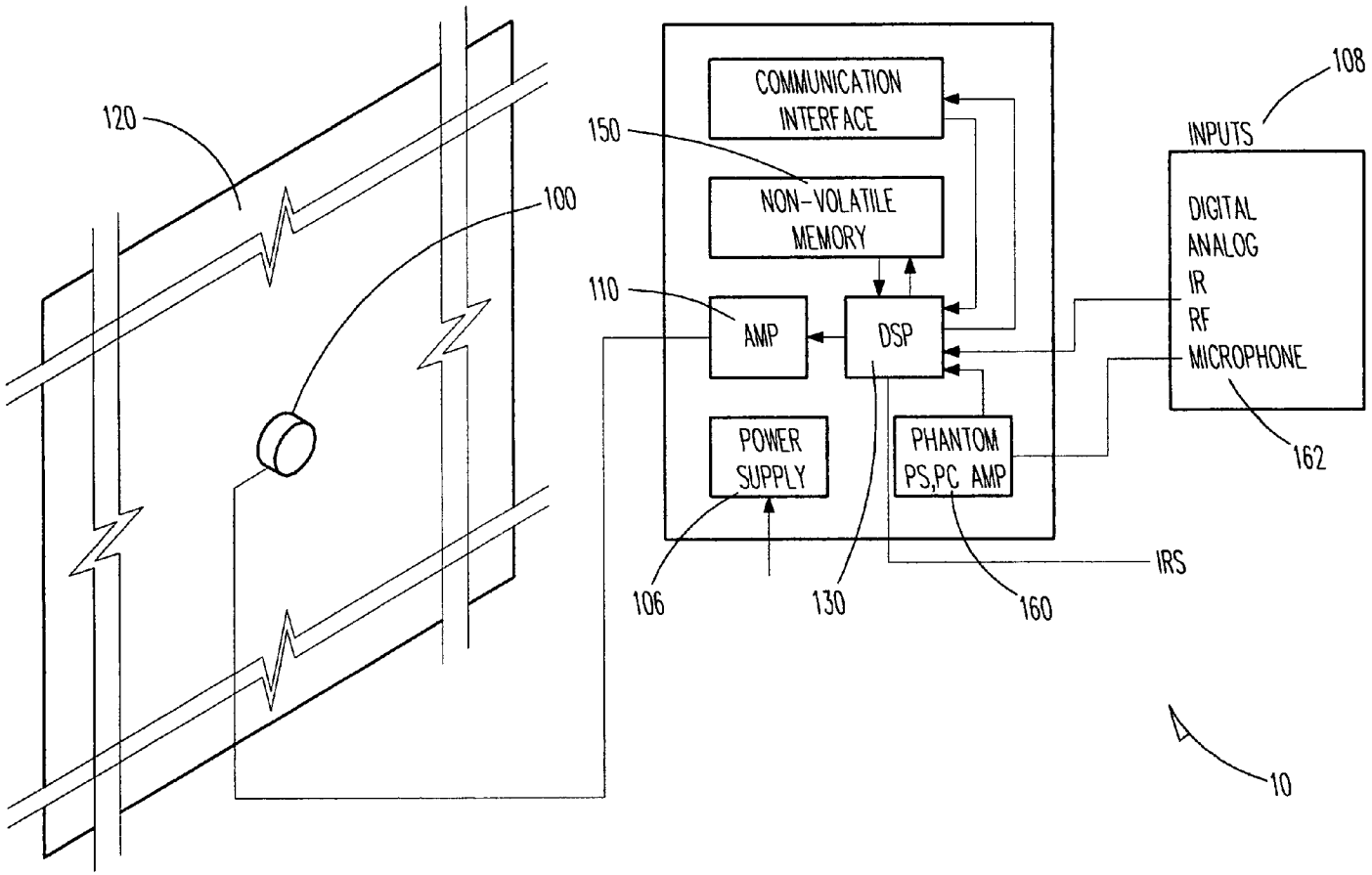
FIG. 1 is a block diagram of the overall system of the invention.

Referring first to FIG. 1 the acoustic system 10 is generally described as an acoustical soundboard panel or body 120 and an acoustic momentum type transducer 100. In the preferred embodiment, said transducer 100 is in acoustic association with said soundboard 120. A power amplifier 110, and means for processing a sound signal 130, at least one input acoustic signal 408 and a power supply 106 complete the basic system 10. In the preferred embodiment, means to process is a Digital Signal Processor. The system 10 may include an active acoustic source 12 such as background music or masking noise. The acoustical soundboard 120 comprises a traditionally non acoustic body or geometric definition and is typically comprised of, but not limited to, gypsum wallboard, wood sheet goods, fiber reinforced composites, structural panels comprising of skins and core, consolidated organic fiber, paper, steel, aluminum, glass, wood, consolidated mineral fibers, plastic and other materials where the mechanical bending impedance varies from 10 to 100,000 N·m. The momentum type transducer 100 is an acoustical exciter that transforms electrical energy into mechanical displacement. The momentum type acoustic transducer 100 is in acoustic association with the acoustic soundboard 120 where the mechanical output (displacement) is input into the acoustical soundboard 120. The mounting location of the acoustic transducer 100 is non specific relative to the geometry of the acoustic soundboard 120. The power amplifier 110 is in the preferred embodiment a digital amplifier.

In the present invention, the soundboard 120, inertial acoustic transducer 100 and the power electronics (110-130) work as a system. The soundboard 120 and acoustic transducer 100 properties are largely predetermined. Thus it is necessary to affect the overall acoustic output of the system 10 to result in a reduction of magnitude distortion. This affect is accomplished by causing preferential adaptation in the power electronics where its amplified signal is inversely distorted to improve the acoustic fidelity of the overall system.

The proposed amplifier architecture in this invention may be configured such that the digital signal processor 130 will initialize an equalization algorithm when a microphone or other means for detecting sound is associated with said means for processing sound signal 130. Means for detecting sound 162 causes mans to process a sound signal 130 to initialize a series of test signals that can be, for example, white noise, filtered noise, MLS, swept sine or other stimulation signals. A frequency response analyzer is then utilized to compute the resulting acoustic frequency response of the system. Means to equalize 145 can equalize using conventional algorithms such as parametric, graphical or inverse Fourier Transform ($F^{-1}$) filters.

An inverse Fourier Transform filter may be used by the present invention. It results in the calculation of the compensation filter $F^{-1}$ by inversing the overall frequency response F of the system. The measured, smoothed, overall magnitude response F is divided into a defined target response to provide an inverse spectral description of the overall system compensating filter response. The compensation filter estimate $F^{-1}$ is derived from the complex spectrum defined by the inverse magnitude and the inverse phase response of the overall frequency response F. The coefficients of the compensation FIR filter can now be calculated by deriving corresponding filter coefficients by merely applying an inverse Fourier transform to the inversed transfer function, directly deriving the impulse response (e.g. the coefficients) of the filter.

In many applications where the acoustic system (soundboard 120, transducer 100 and electronics 110, 130) will be embedded in serial production structures, or structures with similar overall properties e.g. furniture panel surfaces, a predefined equalization curve is determined and then stored in an addressable non volatile memory 150. By selecting the appropriate memory address, the amplifier can be configured to the optimal setting without any other interfacing requirement.

The invention can include said means to equalize 145. Specifically, the digital signal processor 130 may apply, but is not limited to, the following plurality of parameters 140: parametric equalization or graphic equalization. Said plurality of parameters is preferably stored in a nonvolatile memory 150. In the preferred embodiment of the power amplifier 110, the digital signal processor 130 will also include N×M matrix mixing where N is the number of input channels and M is the number of amplification channels, digital crossover with Linkwitz-Riley, Butterworth and Bessel filters, frequency and gain selectable bass and treble tone control, time delay, independent and master gain control, compression limiting, loudness and psycho-acoustic bass extension. The plurality of parameters 140 may be pre-programmed in the non-volatile memory 150 where upon selection of the appropriate memory registrar 152, the plurality of parameters or one of said parameters 140 will be recalled to optimize the various processing functions for a particular acoustic soundboard 120 and transducer 160 combination. Also, integrated with the digital signal processor 130 is a phantom power supply 160 to power means for detecting sound 162. In the preferred embodiment, means for detecting sound comprise a microphone 162 or an accelerometer where the overall system response of FIG. 1 may be measured to optimize frequency distortion of the overall acoustic system 10. The power amplifier 110 may be replaced by other means to amplify various signal types 110, such as but not limited to, music, voice paging, announcements, and noise masking.

Figure 2:
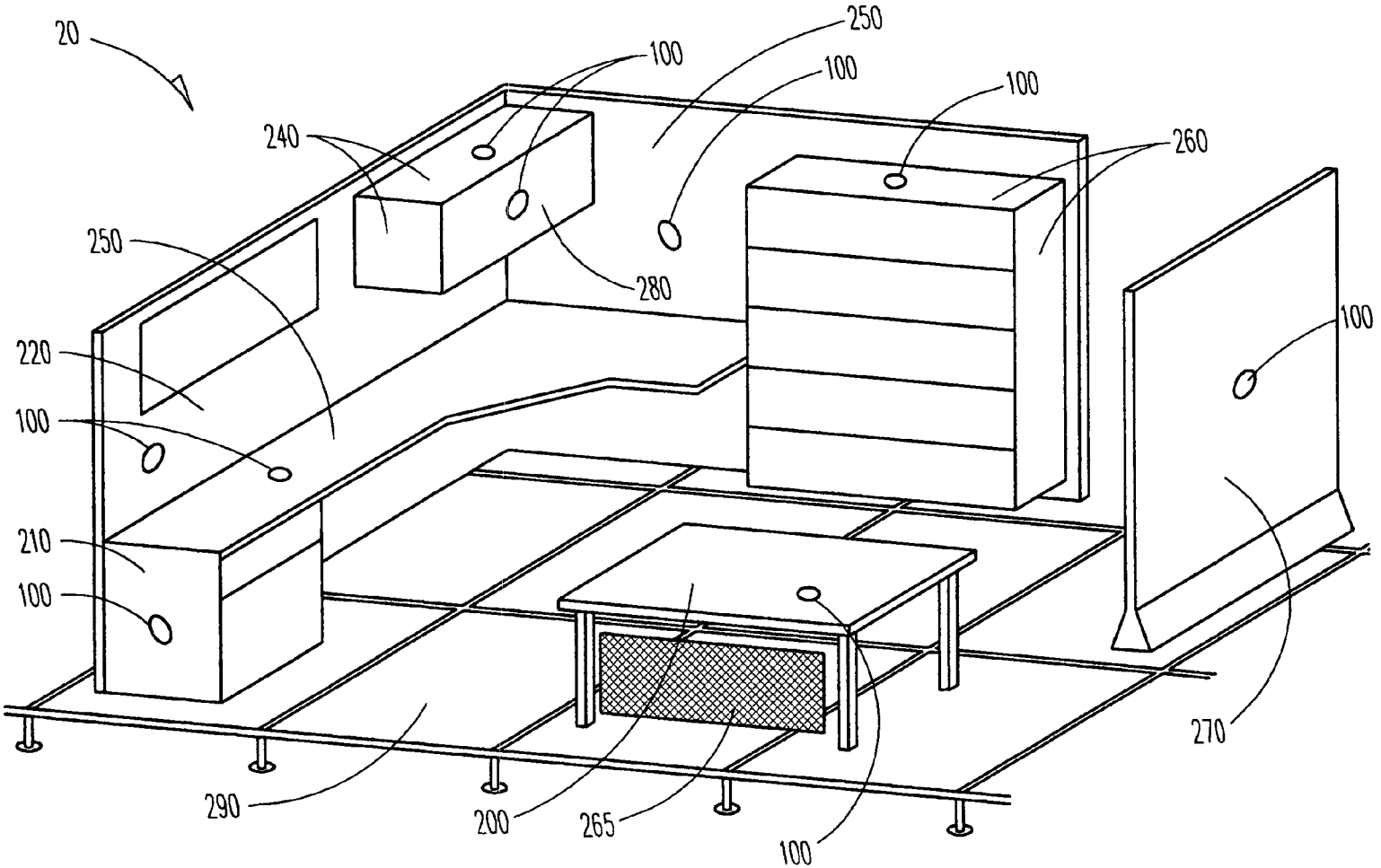
FIG. 2 is a view of prototypical office furniture having installed therein acoustic transducers

FIG. 2 refers to a prototypical office 20 with surfaces that are suitable for distributed acoustical soundboards 120. The suitable surfaces are tables 200, side panels 210, 260 modesty panels 265 and dust panels 240 of cabinets and filing systems, doors 280 of cabinets, work surfaces 230, acoustic partitions 250 and segmented panel partitions 220, stand alone acoustic partitions 270 and, elevated flooring panels 290. The soundboards 120 are each in acoustic association with a momentum type transducer 100.

Figure 3:
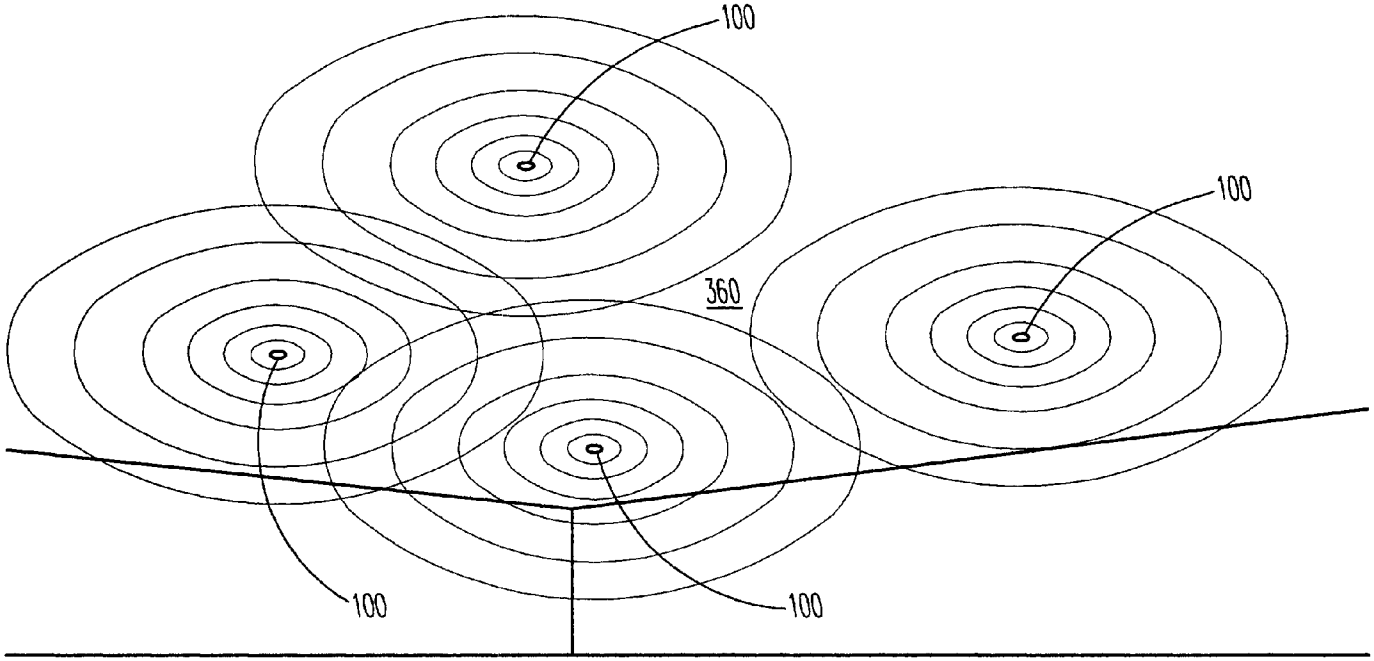
FIG. 3 is a view of a ceiling having installed therein acoustic transducers

FIG. 3 refers to a ceiling system 360 comprised of gypsum wallboard, architectural wood, glass, metal or other composite materials that is either directly attached to ceiling joists or a suspension grid system (not shown). Attached to the ceiling system 360 are a plurality of momentum type acoustic transducers 100 at various locations. The mounting locations of the transducers 100 may either be regularly spaced or irregularly spaced according to actual layout plan of the space.

Figure 4:
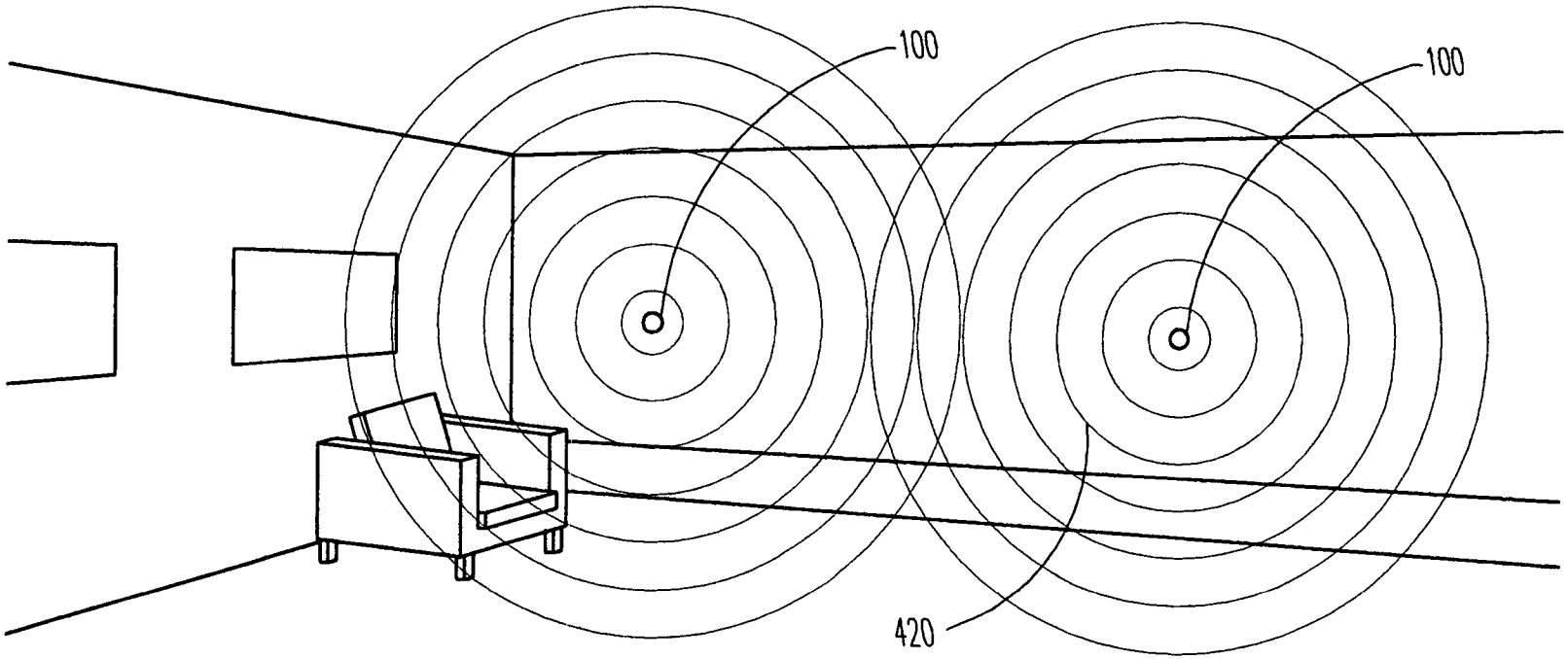
FIG. 4 is a view of a wall having installed therein acoustic transducers

FIG. 4 refers to a wall system 420 comprised of gypsum wallboard, architectural wood, glass, metal or other composite materials that is either directly attached to wall studs or other structural support system (not shown). Attached to the wall system 420 are a plurality of momentum type acoustic transducers 100 at various locations. The mounting locations of the transducers 100 may either be regularly spaced or irregularly spaced according to actual layout elevation of the space.

The induced mechanical motion to the acoustic transducer 100 can cause it to operate in a non-linear manner thus introducing other sources of distortion. One means of controlling the reflected bending wave energy employed by the present invention is to dissipate the incident bending wave as it approaches a perimeter 505 of the panel or soundboard 120. Those skilled in the art will recognize that visco-elastic and/or constrained layer type damping are very effective at transforming bending wave energy into heat. A recent development in damping treatment is the sprayable visco-elastic polymer materials such as QuietCoat® 118, 119 and 207 supplied by Quiet Solutions®, 1250 Elko Drive, Sunnyvale, Calif. 94089 which, as applied, creates a visco elastic damper 520. Another means employed in the present invention for controlling reflected bending wave energy is to apply a damping material such as polyurethane foam around the perimeter 505 of the panel 120 which is sandwiched between the panel 120 and a supporting structure (a constrained layer damper) which suspends the panel in its place.

In some applications of the present invention, it will be necessary to mechanically suspend a soundboard panel 120 within a larger structure. It may also be desired to have the soundboard 120 vibrationally isolated from the supporting structure. Those skilled in the art can appreciate the various means of mechanical isolation through visco-elastic mounts, compliant or other type means.

Figure 5:
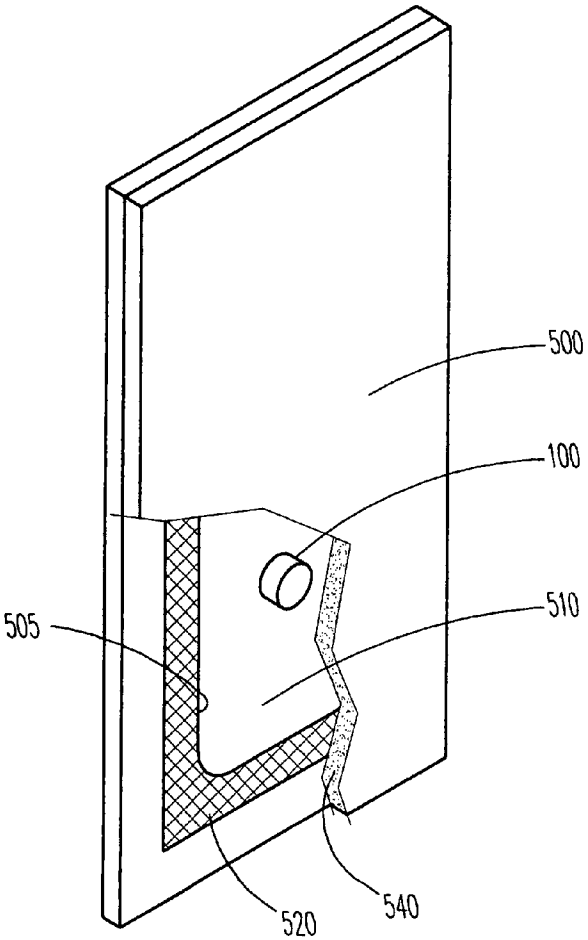
FIG. 5 is a cutaway view of an acoustical panel having acoustic transducer and visco-elastic damping material applied.

More particularly, FIG. 5 refers to an acoustical partition 500 that has a structural panel core 510. An acoustic absorbent material 540 covers said core 510. The structural panel core 510 consists of a material with low internal damping properties such as steel, aluminum or other metallic alloys. Attached to a perimeter 505 of the core 510 is a visco-elastic damper 520 which is used to dampen the induced bending waves of the structural core 510 by the momentum type acoustic transducer 100. In the preferred embodiment, the visco-elastic material of the damper 520 is a butyl rubber based constrained layer damper or a sprayable polymer, however, is should be appreciated that other damping materials may be applied.

Figure 6:
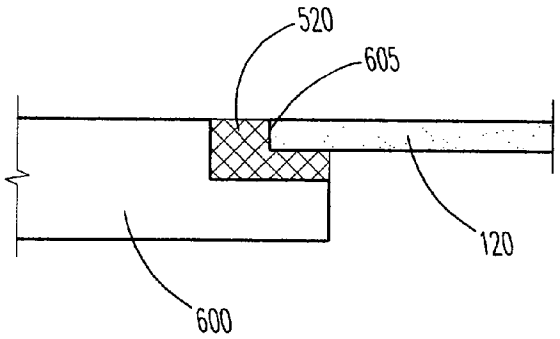
FIG. 6 is a cutaway view of another acoustical panel having acoustic transducer and visco-elastic damping material.

FIG. 6 is a cross sectional view of a soundboard 120 that has at its perimeter 605 a structural supporting frame 600 where a visco-elastic damper 520 is sandwiched between the perimeter of the soundboard 605 and the structural frame 600. The structural frame 600 may cover the full perimeter 605 of the soundboard panel 120 or any fraction thereof.

The invention is well suited to commercial sound applications where voice paging, noise masking, foreground, background and other distributed sound may be required. The use of the acoustic transducer 100, amplifier 110 and networking allows for zone specific control. The digital signal processor 130 has integrated computer interfacing means whereby an external controller may communicate with the amplifier 110 to control its operating parameters 140. These operating parameters are ideally assessable through a graphical user interface. Interfacing and communicating with other computers or controllers is by means through wired and/or wireless networks and may be addressable as a node on a network. This enables the direct distribution and streaming of audio content from centralized network servers. The network may supply a common audio signal to all or a portion of acoustic zones to create background, foreground music, voice paging or emergency signaling. The audio signal source can be, but is not limited to, line level analog mono/stereo, Sony/Philips Digital Interface Format (S/PDIF), direct digital stream or Ethernet packet.

Multiple distributed acoustic sources may be used throughout the built environment. Each separate acoustic source can be considered a node on a network that is individually addressable for specific audio signal input. The ability to address each acoustic source as an individual node enables further optimization in the active acoustic noise control system where specific masking is applied locally near the point of disturbance. In applications where filtered random noise is utilized, sampling of the background noise near each node can be used to shape the noise spectrum so as to be more effective in masking the acoustic disturbance.

Other masking technologies such as Babble® as supplied by Sonare®, 444 N. Wells, Suite 305, Chicago, Ill. 60610 use pre-recorded speech of a talker. The recorded speech is processed so that when played back in conjunction with actual speech of the talker, the intelligibility of the talker is highly disrupted. The present invention when utilized with Babble can monitor the nodes of the network and when a known talker is detected, the surrounding immediate zones can be activated with the corresponding Babble processed signal, thus rendering a zone of privacy for the talker. Masking and or Babble processing my also be employed to create zones of privacy for open area or closed meeting spaces.

Another aspect of the invention is the ability of a local node to introduce a unique audio signal from sources such as but not limited to MP3 players, radios, CD, portable music players, and computers. The local audio signal will be reproduced at the local zone for personalization of that space and mixed in with the other masking signals for that specific zone. It is also conceivable that a locally input audio signal can be shared with other distributed nodes.

Figure 7:
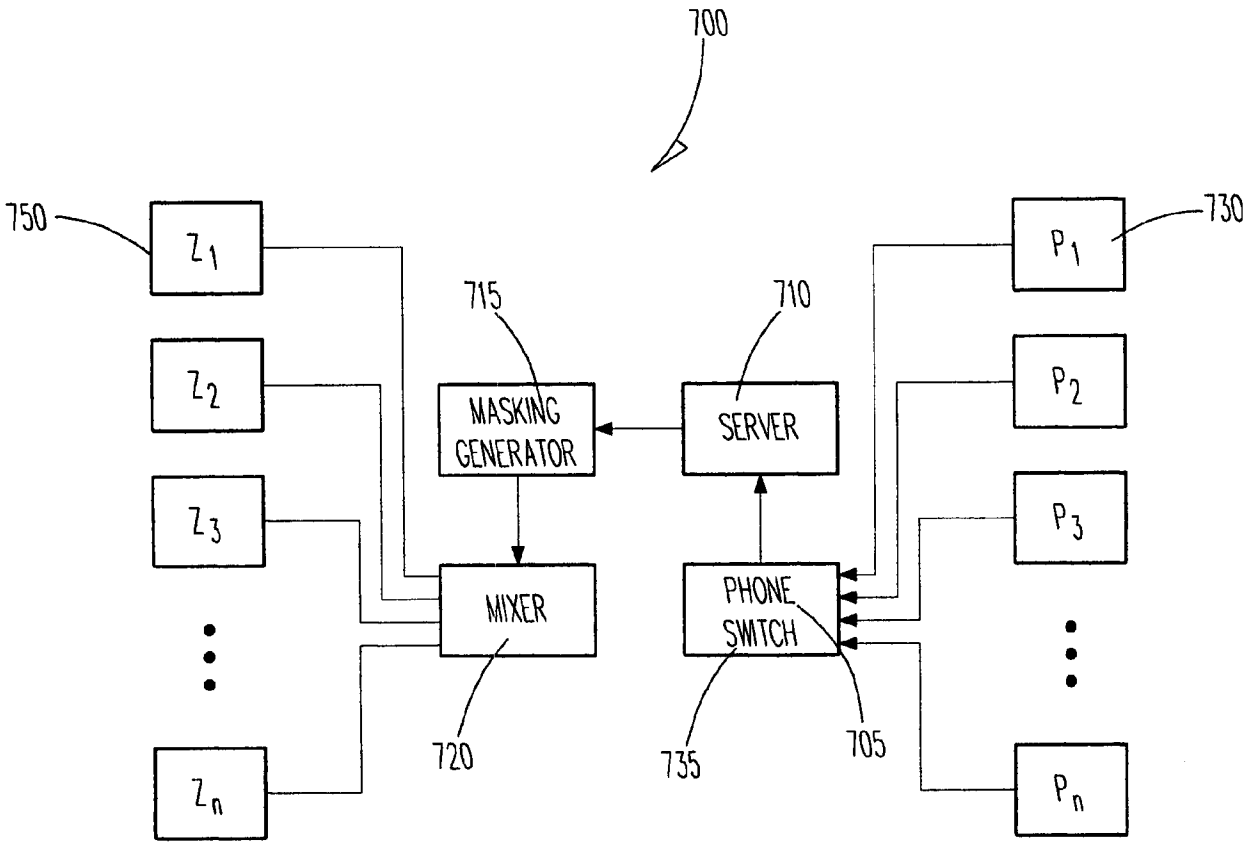
FIG. 7 is a block diagram of a zonal masking generator system

FIG. 7 is a block diagram of the present invention when employed as a multi-zone audio system 700. Said multi-zone system 700 may be employed as a zone masking control system where the input $P_1, P_2, P_3, \ldots P_n$ 730 are received by means for detecting sound 162/707. In the preferred embodiment, said means 707 comprises a telephone receiver, however, there are other possibilities. Detection of a disturbance or input signal 705 (also, 108) is transferred to a phone switch 735 which notifies means to identify said input acoustic signal 710 which, in the preferred embodiment comprises a server or controller. The server 710 identifies the signal 705 and notifies means to generate masking sound 715. The corresponding noise masking signal 716 such as babble, or filtered or unfiltered white noise is generated by the generator 715 and sent through an input output matrix switch also known as a mixer 720. The appropriate noise masking signal may be distributed by the mixer 720 to any one or more of a plurality of active acoustic sources 12 in a plurality of targeted acoustic control zones $Z_1, Z_2, Z_3, \ldots, Z_n$ 750. Preferably, at least one said input sensor 707 is present in each of said plurality of zones. The targeted acoustic control zones 750 are those zones that are in near proximity to the source of the detected disturbance signal (and may also be referred to as proximal audio zones). The server 710 is used as a controller between the phone switch 735 and the mixer 720. The server 710 either causes generation of the appropriate noise masking signal by the generator 715 which is sent to the mixer 720 in accordance with the detected disturbance signal 705 or signals the playback of pre-recorded masking or babble generator. The mixer 720 and the digital signal processor 130 may or may not be integrated.

Figure 8:
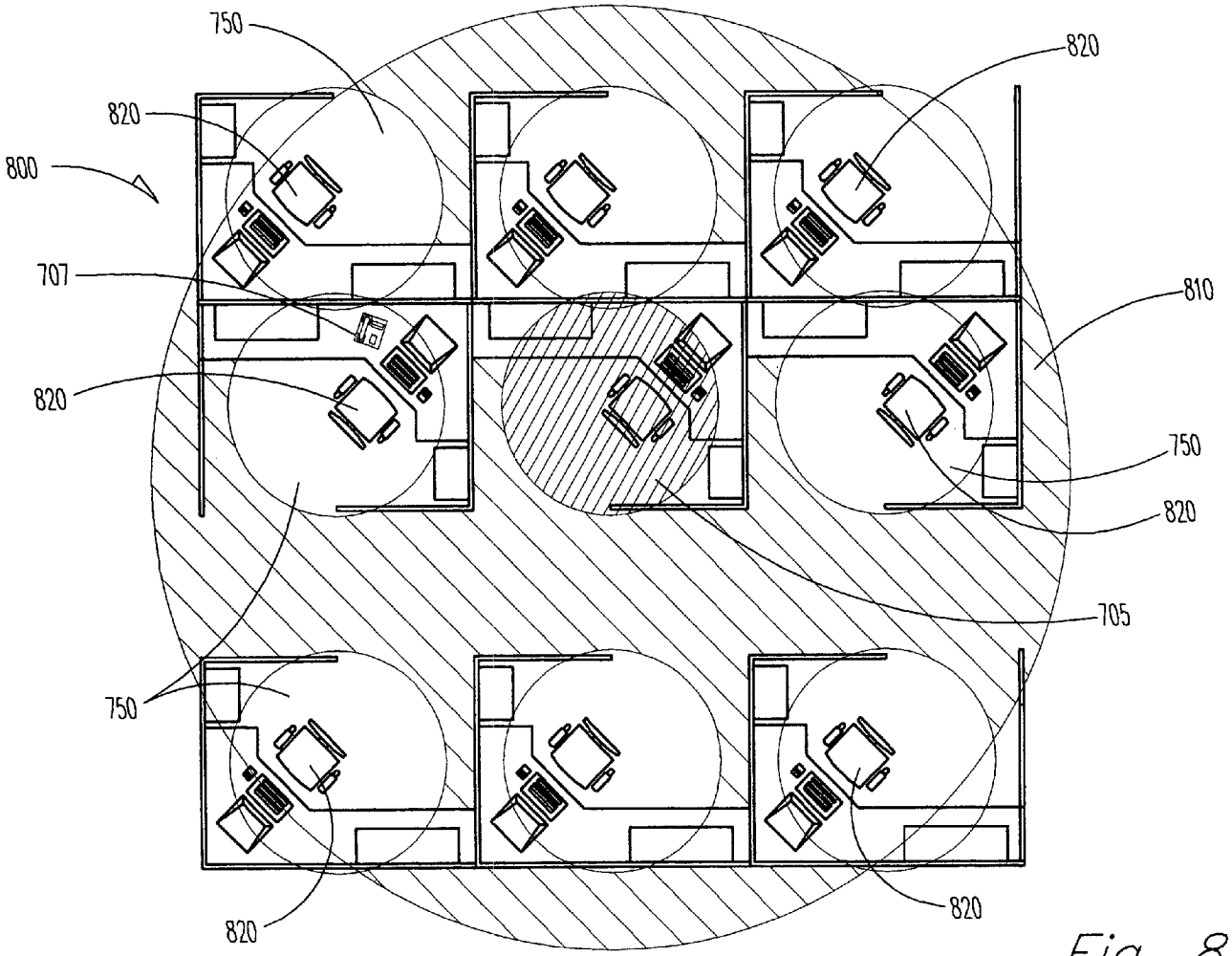
FIG. 8 is a plan view of an open office plan.

FIG. 8 is a plan view of a prototypical office layout 800 where an individual may generate a disruptive signal 705 and is surrounded by other workers at their respective workstations 820. The disturbance signal 705 covers an area 810 (represented by hatchmarcks) which overlaps the other workers at their respective workstations 820. The sensor 707 in FIG. 7 detects the disruptive noise 705 which, through the phone switch 735 signals the server 710. The server 710 either identifies the noise, and notifies the generator 715 which generates instructions for the mixer 720 or simply signals the generator 715 to instruct the mixer 720 to generate a predetermined noise masking or babble signal and to distribute the signal to the proximal audio zones 840 (also 750). Each proximal audio zone 840 is independently controlled and powered.

Thus, the present invention has been described in an illustrative manner. It is to be understood that the terminology that has been used is intended to be in the nature of words of description rather than of limitation.

Many modifications and variations of the present invention are possible in light of the above teachings. For example, the components of the system may be integrated together. Therefore, within the scope of the appended claims, the present invention may be practiced otherwise than as specifically described.

We claim:

1. An audio system, comprising:

a. an input acoustic signal and an acoustic momentum transducer coupled to a means to amplify;

b. a means for processing a sound signal;

c. a body comprising any geometry coupled to said acoustic momentum transducer wherein said body radiates acoustic energy when driven by said acoustic momentum transducer wherein said acoustic momentum transducer is associated at any position on said body; and d. a digital signal processor for measuring said system response and pre distorting the input acoustic signal to optimize frequency distortion of sound generated by the body.

2. The audio system of claim 1, wherein said body comprises a surface selected from the group consisting of gypsum panel walls, gypsum ceilings, gypsum columns, architectural wood, glass and metal paneling and said means for processing comprises a digital signal processor.

3. The audio system of claim 2, wherein the body further comprises a planer surface.

4. The audio system of claim 2, wherein the body comprises a surface curved in either one or more directions.

5. The audio system of claim 2 further comprising a visco-elastic damper, and a constrained layer damper to reduce the reflected bending wave from said body.

6. The audio system of claim 2, wherein said body further comprises a visco-elastic damper to reduce the reflected bending wave from said body.

7. The audio system of claim 1, wherein said body comprises any surface on any element selected from the group consisting of tables, workstations, workstation partitions, acoustic panels, and finished case goods.

8. The audio system of claim 1, wherein the body comprises an elevated floor.

9. The audio system of claim 1, wherein said body comprises at least one glass window.

10. The audio system of claim 1, wherein the body comprises consolidated organic and inorganic fiber.

11. The audio system of claim 1, wherein said body comprises at least one surface selected from the group consisting of composite structures of organic and inorganic fibers bound within an organic and composite structures of organic and inorganic fibers bound in an inorganic matrix.

12. The audio system of claim 1, wherein said body comprises at least one panel having a structural core.

13. The audio system of claim 1, wherein said body comprises a surface and a visco-elastic damper to reduce the reflected bending wave from said body.

14. The audio system of claim 1, wherein said body comprises a surface and a constrained layer damper to reduce the reflected bending wave from said body.

15. The audio system of claim 1 further comprising means for detecting sound.

16. The audio system of claim 15, wherein said means for detecting sound comprise a microphone input.

17. The audio system of claim 16, further comprising a microphone phantom power supply.

18. The audio system of claim 17 further comprising a signal conditioner and a pre amplifier.

19. The audio system of claim 15, wherein said means for detecting sound comprise an accelerometer.

20. The audio system of claim 1 further comprising a psycho acoustic bass extension.

21. The audio system of claim 20, said means for processing a sound signal comprises a digital signal processor and said switch is integrated therewith.

22. The audio system of claim 1 further comprising a switch, wherein said input acoustic signal is passed through said switch.

23. The audio system of claim 1 further comprising a plurality of system parameters, wherein said means for processing a sound signal of said parameters comprises a non-volatile memory for storing said plurality of system parameters.

24. The audio system of claim 1 further comprising means to adapt system response.

25. The audio system of claim 24, wherein said means to adapt system response comprise a parametric equalizer.

26. The audio system of claim 25, wherein said parametric equalizer employs automated frequency analysis and adaptation algorithms.

27. The audio system of claim 26 further comprising means for detecting sound for system response detection.

28. The audio system of claim 27, wherein said means for detecting sound comprise a microphone.

29. The audio system of claim 27 further comprising an accelerometer for system response detection.

30. The audio system of claim 24, wherein said means to adapt system response comprise a graphic equalizer.

31. The audio system of claim 30, wherein said graphic equalizer utilizes automated Real Time Analysis to adapt overall system response.

32. The audio system of claim 24, wherein said means to adapt system response comprise an equalizer employing an inverse Fourier Transform filter.

33. The audio system of claim 24 further comprising a microphone for detecting sound and for system response detection.

34. The audio system of claim 24 further comprising an accelerometer for detecting sound and for system response detection 36.

35. The audio system of claim 1 further comprising an active acoustic source.

36. The audio system of claim 35, wherein the active acoustic source provides foreground music.

37. The audio system of claim 36, wherein the active acoustic source provides background music.

38. The audio system of claim 37, wherein the active acoustic source provides noise masking.

39. The audio system of claim 38, wherein said noise masking comprises white noise.

40. The audio system of claim 38, wherein said noise masking comprises speech processed to create babble.

41. The audio system of claim 38, wherein said noise masking comprises filtered white noise.

42. The audio system of claim 1, wherein said input acoustic signal comprises analog format.

43. The audio system of claim 1, wherein said input acoustic signal comprises digital format.

44. The audio system of claim 1, wherein said system provides a multi-zone distributed audio system and further comprises a plurality of zones.

45. The audio system of claim 44, wherein said multi-zone audio system provides distribution of a common audio signal to each of said plurality of zones.

46. The audio system of claim 44, wherein said multi-zone system provides distribution of a unique audio signal to each of said plurality of zones.

47. The audio system of claim 44, wherein each of said plurality of zones comprises means for detecting sound.

48. The audio system of claim 47, wherein said means for detecting sound comprises a microphone.

49. The audio system of claim 47, wherein said means for detecting sound comprises an accelerometer.

50. The audio system of claim 1 further comprising a plurality of zones and means to identify said input acoustic signal.

51. The audio system of claim 50 further comprising a masking generator wherein said means to identify said signal identifies said signal and causes said generator to generate a masking signal.

52. The audio system of claim 51, wherein said means to identify said input acoustic signal monitors a plurality of input acoustic signals and causes said generator to generate a masking signal appropriate for said plurality of zones.

53. The audio system of claim 52, wherein said means to identify comprises a controller.

54. The audio system of claim 51, wherein said means to identify said input acoustic signal monitors a plurality of input acoustic signals and causes said generator to generate a specific and appropriate masking signal for each of said plurality of zones.

55. An audio system comprising:

an acoustic momentum transducer in acoustic association with a body wherein said acoustic momentum transducer is associated at any position on said body and said body comprises any geometry; and a digital signal processor for measuring said system response and pre distorting an input acoustic signal to optimize frequency distortion of sound generated by the body.

* * * * *